United States Patent [19]

Toshio

[11] 4,050,234

[45] Sept. 27, 1977

[54] ELECTRONIC TIMEPIECE HAND-RETURN MECHANISM

[75] Inventor: Mori Toshio, Suwa, Japan

[73] Assignee: Kabushiki Kaisha Suwa Seikosha, Tokyo, Japan

[21] Appl. No.: 502,133

[22] Filed: Aug. 30, 1974

[30] Foreign Application Priority Data

| | | |
|---|---|---|
| Aug. 30, 1973 | Japan | 48-97748 |
| Sept. 10, 1973 | Japan | 48-101819 |

[51] Int. Cl.[2] ..... G04B 27/08

[52] U.S. Cl. ..... 58/85.5; 58/23 R; 58/34

[58] Field of Search ..... 58/23 R, 34, 85.5, 23 D, 58/37

[56] References Cited

U.S. PATENT DOCUMENTS

| | | | |
|---|---|---|---|
| 3,059,412 | 10/1962 | Epperlein | 58/85.5 X |
| 3,129,554 | 4/1964 | Yasukawa | 58/85.5 X |
| 3,691,753 | 9/1972 | Kurita | 58/85.5 X |
| 3,744,234 | 7/1973 | Kamijo | 58/34 |
| 3,762,153 | 10/1973 | Komiyana et al. | 58/85.5 X |
| 3,813,873 | 6/1974 | Nakagawa | 58/85.5 |
| 3,817,024 | 6/1974 | Noguchi | 58/34 |

*Primary Examiner*—Ulysses Weldon

*Attorney, Agent, or Firm*—Blum, Moscovitz, Freedman & Kaplan

[57] ABSTRACT

A hand-return mechanism for an electronic timepiece wherein at least one hand is returned to a predetermined position and the motor rotating same is correspondingly adjusted. The timepiece includes a display hand mechanically coupled to a positionable gear, the rotational position of the gear determining the rotary position of the hand. An oscillator circuit produces a high frequency time standard signal and a divider circuit produces an alternating polarity pulse of a predetermined low frequency in response to the high frequency time standard signal. An electro-mechanical converter is adapted to rotate the gear by means of a rotor in response to the period of the alternating polarity pulse applied thereto. A manually operated reset mechanism is adapted to be displaced from a rest position to a reset position, the reset mechanism being mechanically coupled to the gear and electrically coupled to the divider circuit, the resetting mechanism effecting a mechanical positioning of said gear and rotor to a predetermined position and a resetting of the divider circuit to stop and then restart the electro-mechanical converter in coordination with the position of said rotor upon the return of the manually operated reset mechanism to a rest position which releases the gear.

15 Claims, 8 Drawing Figures

ELECTRONIC TIMEPIECE HAND-RETURN MECHANISM

BACKGROUND OF THE INVENTION

This invention is directed to a hand display electronic timepiece, and in particular to a hand-return mechanism adapted to position the second hand of an electronic timepiece in a predetermined position in response to the operation of the hand-return mechanism. While mechanisms for positioning the second hand in an electronic wristwatch have taken on various forms, such mechanism have tended to effect the positioning of the other hands of the timepiece, as well as the accuracy of the time counted by the timepiece. In order to overcome such difficulties, additional mechanical elements including clutch mechanisms have been provided in the gear train, such mechanical devices having proved to be less than completely satisfactory. Also, such mechanisms have only provided for the return of the second hand once in any minute even though the accuracy of present day electronic timepieces has created a desirability of positioning the second hand on an electronic timepiece within 10 second increments.

SUMMARY OF THE INVENTION

Generally speaking, in accordance with the invention, a hand-return mechanism for a hand display electronic timepiece is provided. A display hand is mechanically coupled to a gear, the rotational position of the gear determining the rotary position of the hand. An oscillator circuit is adapted to produce a high frequency time standard signal and a divider circuit is adapted to produce an alternating polarity pulse of a predetermined low frequency in resonse to the high frequency time standard signal. An electro-mechanical converter is adapted to intermittently rotate the gear through a specific increment in response to the period of the alternating polarity pulses applied thereto. A manually operated reset mechanism is mechanically coupled to the gear and electrically coupled to the electro-mechanical converter, and in response to the displacement of the manually operated reset mechanism from a rest position to a reset position, effects a return of said gear to a predetermined postion, and a resetting of the electromechanical converter to a state corresponding to the predetermined position of the gear.

Accordingly, it is an object of this invention to provide an improved hand-return mechanism for a high precision electronic timepiece.

Another object of this invention is to provide an improved hand-return mechanism adapted to return the second hand to zero without affecting the precision or accuracy of a timepiece.

Still another object of this invention is to provide an improved electronic timepiece wherein a clutch mechanism is not needed to return the second hand to zero.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENTS

Figure 1:
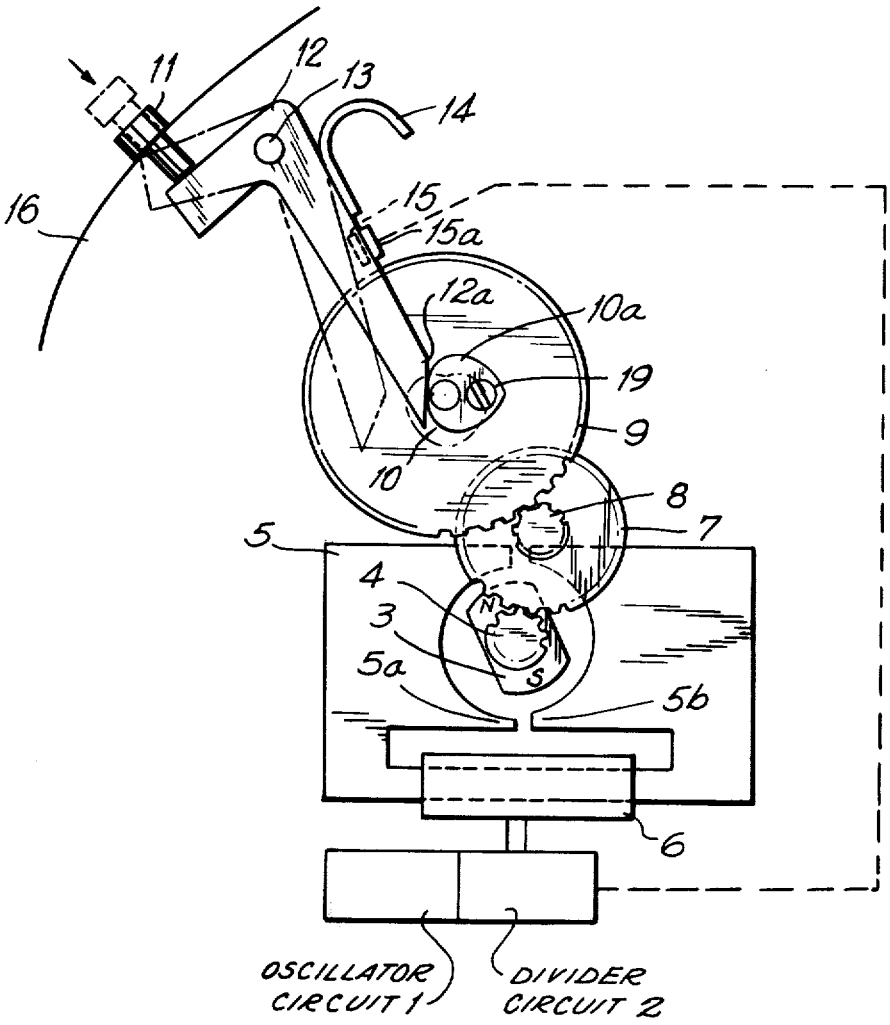
FIG. 1 is an elevated view of an electronic timepiece hand-return mechanism constructed in accordance with the instant invention.

Reference is now made to FIG. 1 wherein a hand display electronic timepiece including a hand return mechanism constructed in accordance with the instant invention is depicted. The electronic timepiece includes a quartz crystal oscillator circuit 1 adapted to produce a high frequency time standard signal and a divider circuit 2 adapted to produce an alternating pulse low frequency signal, specifically illustrated in FIG. 4, in response to the high frequency time standard signal. The low frequency pulse signal is applied to a coil 6 of a step motor which includes a stator 5 and a rotor 3. The rotor 3 is enclosed by a stator 5 and in response to the opposite polarity pulses applied to coil 6 by divider circuit 2, is rotated 180° for each pulse applied thereto. If the alternating polarity pulse has a period of 1 second, the rotor is rotated 180° for each second by the attraction and repulsion of the rotor and stator with respect to each other. The rotor remains at a rest position between pulse applications, as is indicated in FIG. 1, the rest position being determined by the air gap between the rotor 3 and portions 5*a* and 5*b* of the stator 5. A rotor pinion 4 is mounted to the rotor 3 and in response to the rotation of the rotor effects a rotation of a fifth wheel 7 and a fifth wheel pinion 8 mounted thereto. The fifth wheel pinion 8 is mechanically coupled to a fourth wheel 9, the fourth wheel 9 being rotated in response to rotation of the rotor. A second hand (see FIG. 2) is mounted to the fourth wheel 9 and is rotated thereby. The fourth wheel 9 is further adapted to rotate a third wheel (not shown) having a minute hand mounted thereto, and a second wheel (not shown) having a minute hand mounted thereto in a well known manner.

A heart-shaped cam 10 is concentrically coupled to fourth wheel 9 and is joined thereto by an eccentric pin 19 which is adapted to allow for adjusting the relative position between the heart-shaped cam 10 and the fourth wheel 9. Accordingly, absent engagement of cam 10 by a hammer 12, the heart-shaped cam and the fourth wheel 9 are adapted to be incrementally rotated once each second by the movement of the rotor 3.

The hammer 12 is maintained out of contact with the heart-shaped cam 10, by a hammer spring 14, the hammer spring maintaining the hammer in a rest position indicated in phantom in FIG. 1. A push button 11 remains in an outward position indicated by dash lines and is maintained in said outer position by the force of the hammer there against, in response to positioning of the hammer by the hammer spring 14 in the rest position.

Accordingly, if it is desired to return the second hand of the timepiece to zero, the push button 11 is depressed, thereby effecting counterclockwise rotation of hammer 12 about pivot 13. The end of the hammer 12*a* effects a rotation of the heart-shaped cam from any position thereof into the stable position 10*a* thereby effecting a positioning of the fourth wheel 9 to the predetermined position. Accordingly, if it is desired to return the second hand to zero, the stable position of the heart-shaped cam is selected so that the fourth wheel will be positioned to thereby return the second hand to zero. Also, the rotation to the heart-shaped cam 10 is transmitted to the rotor 3 through the fourth wheel 9, fifth wheel pinion 8, the fifth wheel 7, and the rotor pinion 4, but in view of the absence of any mechanical strains on the rotor 3 for reasons hereinafter discussed, no problems are presented thereby.

Figure 2:
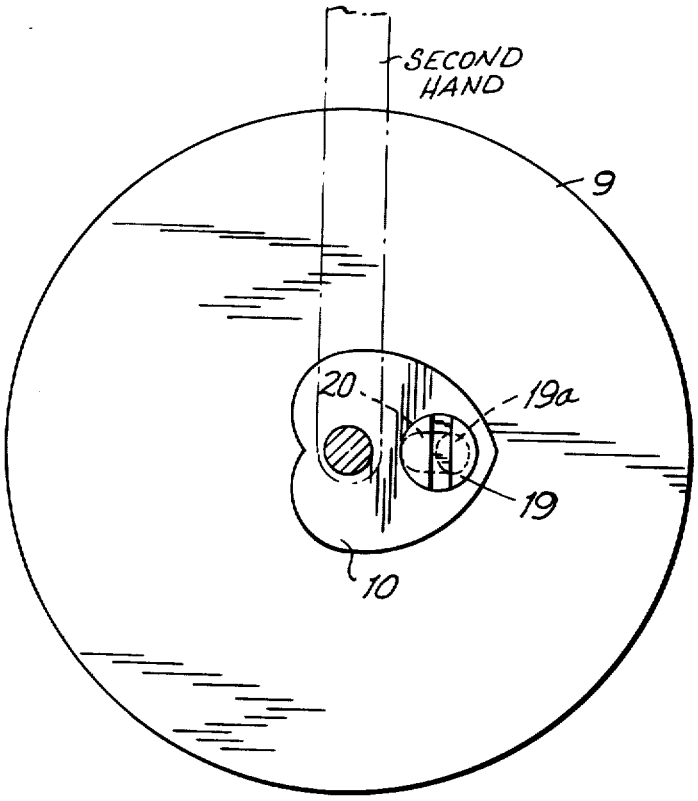
FIG. 2 is an elevated view of the cam utilized in the hand-return mechanism depicted in FIG. 1.
Figure 3:
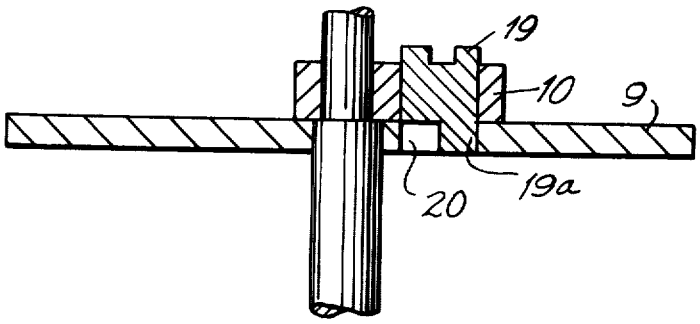
FIG. 3 is a partially sectioned plan view of the cam mechanism illustrated in FIG. 2.

In order to insure that the stable position 10*a* of the heart-shaped cam 10 and the rest position of the rotor 3 coincide with each other, eccentric pin 19, more particularly illustrated in FIGS. 2 and 3, is rotatably mounted on heart-shaped cam 10 at a position spaced from the axis of rotation of the cam. The eccentric pin 19 is formed with a projecting peg 19*a* offset from the axis of pin 19 and adapted to be disposed in an elongated slot 20 bored in the fourth wheel 9, the rotation of the eccentric pin 19 effecting a fine adjustment of the relative positions between the heart-shaped cam 10 and the fourth wheel 9. It is noted that such an adustment can also be effected by providing an eccentric pin as the pivot 13 for the print hammer. This adjustment controls the phase relation between heart-shaped cam 10 and rotor 3. Provision of such fine adjusting means between the rotor 3 and heart-shaped cam 10 will insure that once such an adjustment is effected after assembly of the timepiece, the rotor will always return to its rest position when the heart-shaped cam 10 is returned to its stable position 10*a*.

A reset switch 15 is mounted on the plate which supports the watch and rotation of the print hammer from a rest to a reset position effects a closing of the reset switch at 15*a*, at a time coincident with positioning of the heart-shaped cam by the hammer 12. Accordingly, the reset switch can be utilized to prevent the actuation of the step motor when the hammer 12 engages cam 10 to prevent strain on the gear therein during reset.

Figure 4:
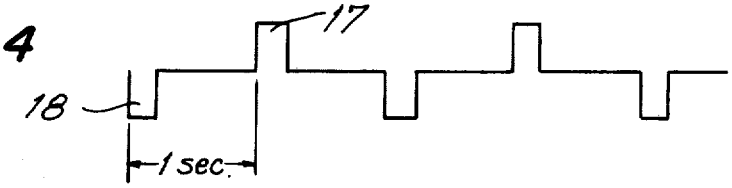
FIG. 4 is a wave diagram of the low frequency drive pulse produced by the divider circuit illustrated in FIG. 1.
Figure 5:
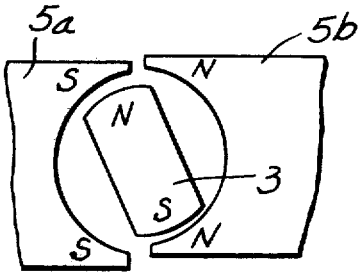
FIGS. 5 and 6 are partial elevated illustrations of the position of the rotor during operation of the hand-return mechanism illustrated in FIG. 1.
Figure 6:
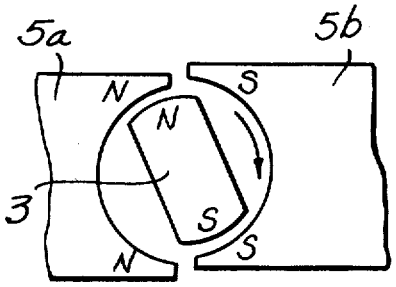

The reset switch 15 is more particularly explained by reference to FIGS. 4 through 6 wherein the use of the second hand return mechanism when it is desired to return the seconds hand to an even position, is illustrated. The opposite polarity pulse includes positive pulse 17 and a negative pulse 18, the opposite polarity pulses effecting inversion of the polarity of the portions 5*a* and 5*b* of the stator and therefore alternate polarizing of the stator portions from north to south poles. As noted above, when the second hand is returned to zero, the hammer will contact reset switch 15 closing same to thereby terminate the application of the pulse signal to the step motor. When the depression force is removed from the button, the button is returned to the rest position by the force of the hammer spring displacing hammer 12 to a rest position taking same out of contact with the reset switch 15. Since the opening of the reset switch determines the time at which the signals are again applied to the step motor, the pulses will be immediately applied to the step motor to polarize the stator portions. If negative pulse 18 is applied upon the release of reset switch 15, the polarities of portions 5*a* and 5*b* of the stator are as illustrated in FIG. 5, and the rotor and the stator will attract each other and there will be no stepping of the motor. Thus, it is noted that even though the rest position of the rotor is altered by the backlash of the wheels, etc., the rotor is returned to its normal rest position by the first negative pulse after release of reset switch 15 and stops in that state. Accordingly, after the lapse of a second, the next pulse applied is positive pulse 17 which polarizes the stator portions 5*a* and 5*b* in the manner indicated in FIG. 6, thereby effecting a repulsion force between the rotor and stator and accordingly a stepping of the rotor through 180°. Subsequent thereto the equal and opposite polarity pulses will continue to step the motor 180° each second. Thus, the second hand is set to move from an even number second such as zero to an odd number second when the positive pulse is generated and from an odd number second to an even number second when a negative pulse is generated. Thus, if reset push button 11 is released coincident with a zero second time standard, the second hand will advance to 1 second, one second later. Reset switch 15 is coupled to divider circuit 2 and in particular to the last stage thereof which produces the one second pulse signal of FIG. 4. Said one-second divider stage is selected so that, upon the application of a signal from reset switch 15, the divider stage stops counting preferably while the higher frequency divider stages and the oscillator continue to function. The one-second divider stage is further selected so that upon release of reset switch 15, the first pulse produced is negative pulse 18, in response to which the rotor 3 is more precisely positioned at its reset position but is otherwise not advanced. One second later, positive pulse 17 is produced to advance the rotor and second hand. The foregoing is for the case where the resetting cam is set to return the second hand to an even second position. Of course, resetting the second hand to an odd number position would require that the one-second divider stage produce a positive pulse when reset switch 15 is opened, so that one second thereafter a negative pulse would effect a stepping of the second hand.

As is illustrated in FIG. 1, push button 11 is provided with an enlarged head which engages plate 16 to limit the displacement of hammmer 15, to thereby avoid damage to the gear train.

It is noted, that the instant invention allows the timepiece to effect an accurate return of the second hand to a predetermined position by interlocking the hammer with the reset switch and determining the direction and time of the pulse produced just subsequent to resetting. Moreover, the return of the second hand to zero can be effected by the heart-shaped cam without altering the relationship between the wheels interconnecting the cam and the rotor, thereby eliminating the necessity for any second jumpers, etc., in the gear train. Furthermore, it is noted that the increased reliability attained with a reduced number of parts, is a clear benefit in a small-sized electronic wristwatch.

It is further noted that although a two-pole step motor has been illustrated by way of example, a multiple pole motor such as a six-pole motor or a continuously turning motor is contemplated in the instant invention. The use of such a hand-return mechanism further provides for the elimination of a deceleration wheel between the fourth wheel and the rotor, and enables the use of a jumper on the hammer to obtain a substantially instantaneous zero second return as well as the use of the winding stem as the hand-return push button.

Figure 7:
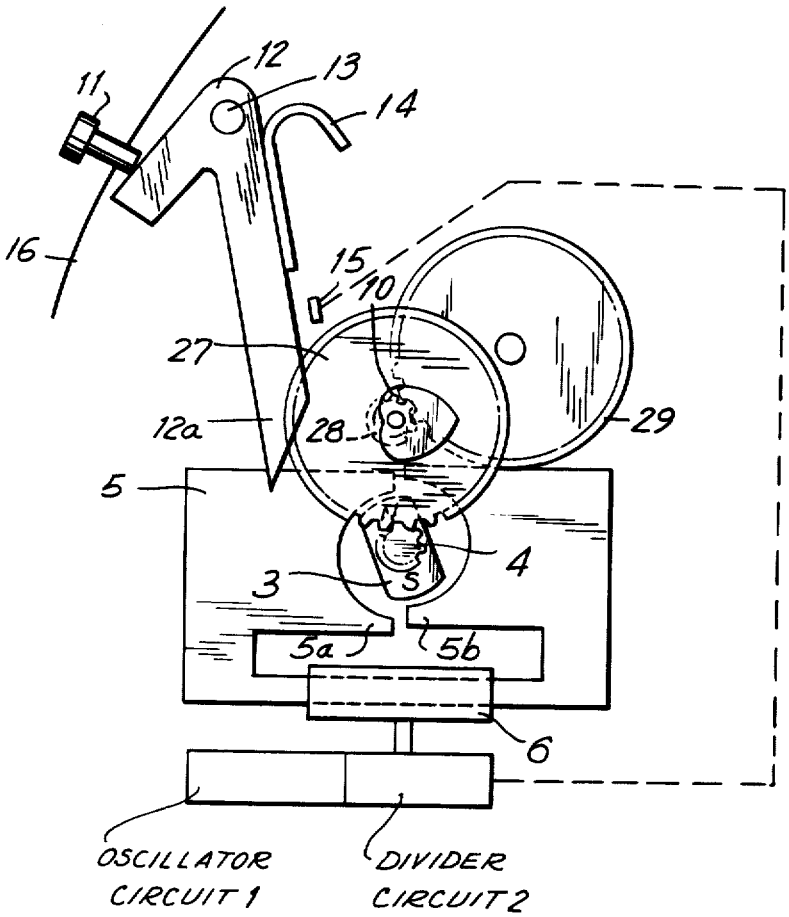
FIG. 7 is an elevated view of another embodiment of the hand-return mechanism constructed in accordance with the instant invention.

Reference is now made to FIG. 7, wherein an alternative embodiment of the instant invention is depicted, like reference numerals being utilized to denote like elements. The fifth wheel 27, has mounted thereto the fifth wheel pinion 28 which is adapted to drive a fourth wheel 29 having a second hand (not shown) mounted thereto. The heart-shaped cam 10 is mounted to the fifth wheel 27, the ratio of the number of teeth on the fourth wheel 29 to that of the fifth wheel pinion 28 and the ratio of the teeth on the fifth wheel 27 to that of the rotor pinion 24 being set at 6:1 and 5:1, respectively. Although the positioning of the heart-shaped cam is effected in the same manner as illustrated in FIG. 1, because the fourth wheel has six positions caused by the above-noted ratio of teeth, the second hand can be positioned at 10 second increments and the reset switch 15 is adapted to provide a pulse signal at 10 second intervals.

Figure 8:
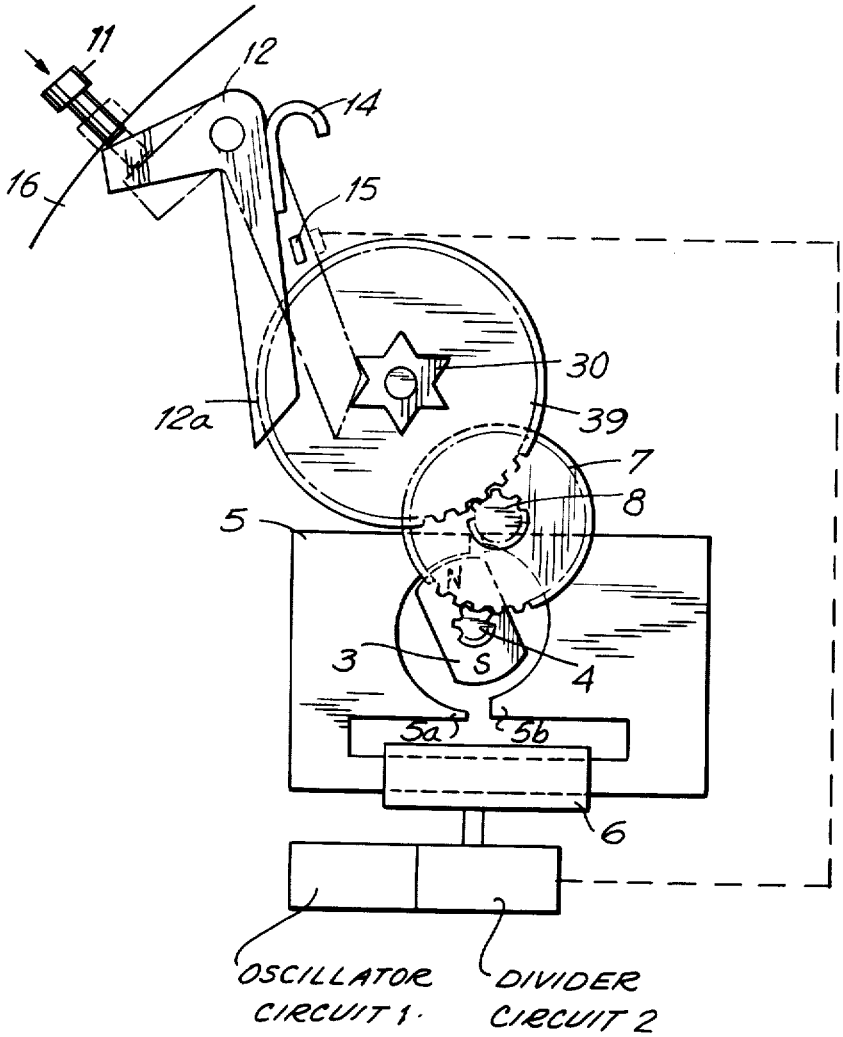
FIG.8 is still another embodiment of a hand-return mechanism constructed in accordance with the instant invention.

Reference is made to FIG. 8, wherein still another embodiment of the instant invention is depicted, like reference numerals being utilized to denote like elements. Instead of a heart-shaped cam 10, a star-shaped cam 30 is provided on a fourth wheel 39 in order to effect a 10 second positioning of the second hand at 10 second increments. Because the star-shape has six distinct positions, displacement of the hammer into contact therewith will effect the 10 second positioning of the second hand thereby rendering possible an easy and quick correction of the seconds display by the use of a reference tone from a telephone. It is noted that a six sided cam would be equally effective in achieving such a ten second interval correction.

Finally, it is noted that a triangular cam or a rectangular cam could equally be utilized if a 20 or 30 second return capability is desired. Furthermore, the consideration of the declaration ratio from the rotor to the wheel carrying the second hand can be utilized to obtain any incremental return desired.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention which, as a matter of language, might be said to fall therebetween.

What is claimed is:

1. In a hand display electronic timepiece having a gear mechanically coupled to at least one of said hands, the rotational position of the gear determining the time indication position of said hand, an oscillator circuit for producing a high frequency time standard signal, divider circuit means for supplying an alternating polarity pulse signal of a predetermined low frequency in response to said high frequency time standard signal, said divider means being adapted to supply a pulse signal including first and second predetermined pulses in sequence immediately after resetting thereof, electro-mechanical converter means coupled to said divider circuit means to receive said pulse signal and including a rotor mechanically coupled to said gear to rotate said gear in response to said pulse signal, the improvement comprising manually operable resetting means mechanically coupled to said gear and electrically coupled to said divider means, said resetting means effecting a positioning of said gear and rotor to predetermined respective positions corresponding to $10n$ second positions of said hand, where $n = 1, 2, 3$, and resetting of said divider means so that the first pulse applied to said electro-mechanical converter means after release of said gear and rotor is adapted to retain said rotor at its predetermined position, the second pulse advancing said gear and said rotor.

2. A hand display electronic timepiece as claimed in claim 1, wherein said manually operable resetting means includes a cam concentrically joined to said gear, and a hammer adapted to position said cam in at least one predetermined position in response to a displacement of said hammer from a rest position to a reset position.

3. A hand display electronic timepiece as claimed in claim 2, wherein said manually operable reset means includes a hammer spring and a manually displaceable actuation member coupled to said hammer, said hammer spring maintaining said hammer in a rest position in the absence of a force applied to said actuation member.

4. A hand display electronic timepiece as claimed in claim 3, including stop means for limiting the displacement of said hammer to prevent damage to said cam and gear during resetting.

5. A hand display electronic timepiece as claimed in claim 2, wherein said cam is heart-shaped.

6. A hand display electronic timepiece as claimed in claim 1, wherein said electro-mechanical converter means is a step motor having a rotor adapted to be stepped in response to the alternate polarity pulses applied to said step motor, the rotation of said rotor effecting a corresponding rotation of said gear.

7. A hand display electronic timepiece as claimed in claim 2, wherein said cam and gear are coupled by an eccentric coupling member, said eccentric coupling member being adapted to adjust the relative rotational orientation of said cam and rotor to adjust said predetermined position of said rotor.

8. A hand display electronic timepiece as claimed in claim 7, wherein said electro-mechanical converter means is a step motor having a rotor adapted to be stepped between rest positions in response to the alternating polarity pulses applied thereto, each said predetermined position of said rotor being such a rest position.

9. A hand display electronic timepiece as claimed in claim 8, wherein said manually operable resetting means includes reset switch means coupled to said divider means and actuated by said hammer, said first pulse after disengagement of said hammer from said reset switch means being of a polarity such that said rotor is held in said rest position.

10. A hand display electronic timepiece as claimed in claim 2, wherein said hand is a second hand, and at least one of said predetermined positions of said gear is a zero second display.

11. A hand display electronic timepiece as claimed in claim 2, wherein said cam has more than one predetermined position for positioning said hand in one of a corresponding number of positions.

12. A hand display electronic timepiece as claimed in claim 11, wherein said cam has six sides and is adapted to be positioned by said hammer in one of six predetermined positions.

13. A hand display electronic timepiece as claimed in claim 12, wherein said cam is shaped like a six point star, and said hammer is adapted to position said cam in one of six predetermined positions in said rest position.

14. In a hand display electronic timepiece including at least one hand and having a gear mechanically coupled to said hand, the rotational position of the gear determining the rotary position of said hand, an oscillator circuit producing a high frequency time standard signal, divider circuit means for supplying an alternating polarity pulse of a predetermined low frequency in response to said high frequency time standard signal, electro-mechanical converter means adapted to intermittently rotate said gear through a specific increment in response to the period of said alternate polarity pulse supplied thereto, the improvement comprising camming means concentrically mounted to said gear and having at least one predetermined orientation, the camming means being adapted to rotatably position said gear at predetermined positions corresponding to $10n$ second positions of said hand, where $n = 1, 2, 3$, and manually displaceable reset means for engaging said camming means to effect a rotation of said gear to one of said predetermined positions in response to the displacement of said reset means from a rest to a reset position.

15. In a hand display electronic timepiece as claimed in claim 14, wherein said reset means includes a hammer adapted to be pivoted between a rest and reset position at which said hammer engages said camming means, rotation of said hammer into a reset position effecting a positioning of said cam to a predetermined position.

* * * * *